US006478216B2

(12) United States Patent
Wiart

(10) Patent No.: US 6,478,216 B2
(45) Date of Patent: Nov. 12, 2002

(54) PACKAGING SUITABLE FOR FOOD PRODUCTS AND CUT-OUT BLANK FOR FORMING IT

(75) Inventor: Laurent Wiart, Cantigny (FR)

(73) Assignee: Dailycer, Montdidier (FR)

( * ) Notice: Subject to any disclaimer, the term of this patent is extended or adjusted under 35 U.S.C. 154(b) by 0 days.

(21) Appl. No.: 09/739,123

(22) Filed: Dec. 19, 2000

(65) Prior Publication Data

US 2001/0004086 A1 Jun. 21, 2001

(30) Foreign Application Priority Data

Dec. 20, 1999 (FR) ..... 99 16070

(51) Int. Cl.[7] ..... B65D 5/355

(52) U.S. Cl. ..... 229/101; 229/149; 229/155; 229/902

(58) Field of Search ..... 229/101, 101.2, 229/126, 149, 155, 902; 206/541; 383/2, 86; 426/115

(56) References Cited

U.S. PATENT DOCUMENTS

| | | | | |
|---|---|---|---|---|
| 1,743,681 A | | 1/1930 | Neuman | |
| 1,953,885 A | * | 4/1934 | McAleer | 229/149 |
| 2,178,730 A | * | 11/1939 | Stein | 229/126 |
| 2,345,486 A | * | 3/1944 | Leebov | 229/149 |
| 2,789,751 A | * | 4/1957 | Feldman | 229/149 |
| 3,403,839 A | | 10/1968 | Farquhar | |
| 4,238,068 A | | 12/1980 | Ellerbe et al. | |
| 4,484,683 A | * | 11/1984 | Werner, Jr. | 229/101.2 |
| 4,678,882 A | * | 7/1987 | Bohrer et al. | 229/101 |
| 5,083,700 A | * | 1/1992 | Mello et al. | 383/120 |

FOREIGN PATENT DOCUMENTS

| | | | | |
|---|---|---|---|---|
| CH | 674190 A5 | * | 5/1990 | 229/149 |
| FR | 1189297 | | 10/1959 | |

OTHER PUBLICATIONS

French Preliminary Search Report and Annex, Sep. 11, 2000.

* cited by examiner

*Primary Examiner*—Gary E. Elkins
(74) *Attorney, Agent, or Firm*—Stevens, Davis, Miller & Mosher, LLP

(57) ABSTRACT

Packaging suitable for food products has at least one wall which is formed in a semi-rigid material such as cardboard and has at least one edge defining an opening for inserting articles, in particular foods, and at least one first flap articulated to that edge along a folding line. The packaging can be conformed into a service configuration in which the flap uncovers the opening and a first storage configuration in which the flap closes the opening. The wall includes reversible deformation arrangements for conforming the packaging into a second storage configuration in which the first flap clamps the wall in a substantially sealed manner along the folding line and in the area of the edge.

14 Claims, 2 Drawing Sheets

PACKAGING SUITABLE FOR FOOD PRODUCTS AND CUT-OUT BLANK FOR FORMING IT

BACKGROUND OF THE INVENTION

1. Field of the Invention

The present invention relates to packaging suitable for food products and a cutout blank for forming it.

2. Description of the Prior Art

Packaging including at least one wall formed in a semi-rigid material such as cardboard, including at least one edge defining an opening for inserting articles, in particular foods, and at least one first flap articulated to the edge about a folding line, which packaging is adapted to be conformed into a service position in which the flap uncovers the opening and a storage configuration in which the flap closes the opening, is known in the art.

It is routinely used to package a flexible sachet containing foods such as breakfast cereals ("corn flakes"), for example.

In the storage configuration mentioned above the packaging is closed after an irreversible first opening operation in which closure members for making the packaging completely airtight are peeled off or torn.

When it is in the storage configuration, the packaging generally provides a mediocre seal, as a result of which the organoleptic characteristics of its content may be degraded.

An object of the present invention is to provide packaging of the kind mentioned above which provides a better seal when reclosed.

SUMMARY OF THE INVENTION

This object of the invention is achieved by packaging having at least one wall formed in a semi-rigid material such as cardboard, wherein the wall has at least one edge defining an opening for inserting articles, in particular foods, and at least one first flap articulated to the edge along a folding line, which packaging is adapted to be conformed into a service configuration in which the flap uncovers the opening and a first storage configuration in which the flap closes the opening, and in which the wall includes reversible deformation means for conforming the packaging into a second storage configuration in which the first flap clamps the wall in a substantially sealed manner along the folding line and in the area of the edge.

Because of these features, the opening of the packaging can be squeezed shut when the flap is closed again, which limits the exchange of air between the inside and the outside of the packaging, so that the content of the packaging is stored under conditions that are almost as satisfactory as those prevailing before it was opened for the first time.

If the content of the packaging is inside a flexible sachet, clamping the wall of the packaging also holds the sachet in a position in which its top part is rolled up on itself, for example, which further improves the seal obtained.

The present invention also relates to a blank formed in a semi-rigid material such as cardboard and including:

- first, second, third and fourth rectangular panels in succession in that order and connected to each other by first, second and third vertical folding lines,
- a gluing lug connected to the first panel by a fourth vertical folding line,
- first, second, third and fourth flaps respectively connected to the first, second, third and fourth panels by first, second, third and fourth horizontal folding lines,

- fifth, sixth, seventh and eighth flaps respectively connected to the first, second, third and fourth panels opposite the first, second, third and fourth flaps by fifth, sixth, seventh and eighth horizontal folding lines, and
- first and second groups of deformation folding lines formed on the second and fourth panels and on the second and fourth flaps, substantially defining inverted Y-shapes whose branches respectively extend substantially from the middles of the second and fourth horizontal folding lines to the first and second vertical folding lines, on the one hand, and to the third and fourth vertical folding lines, on the other hand, and whose stems are in substantially median areas of the second and fourth flaps.

Other features and advantages of the present invention will become apparent on reading the following description and examining the accompanying drawings.

DETAILED DESCRIPTION OF THE PREFERRED EMBODIMENT

Figure 1:
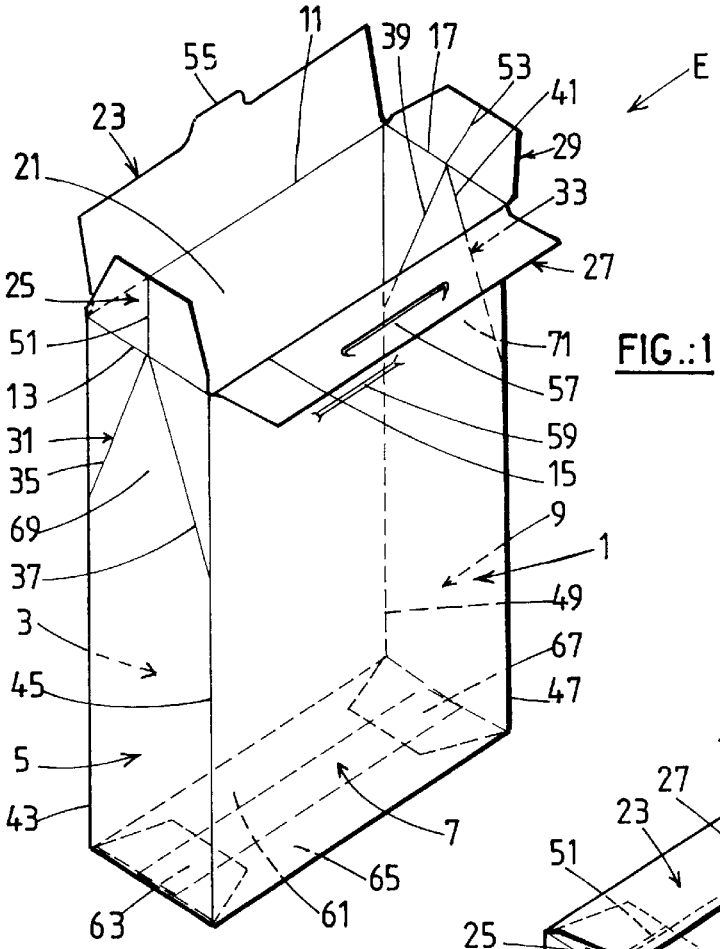
FIGS. 1 and 2 are perspective views of packaging in accordance with the invention, respectively in a service configuration and a first storage configuration.

In the figures, identical reference numerals designate identical or similar components or sets of components.

FIG. 1 shows that the packaging E according to the invention includes a wall 1 defining a volume which is substantially parallelepiped-shaped, for example, when the packaging is in a service configuration (i.e. a configuration enabling it to be emptied or filled).

Figure 5:
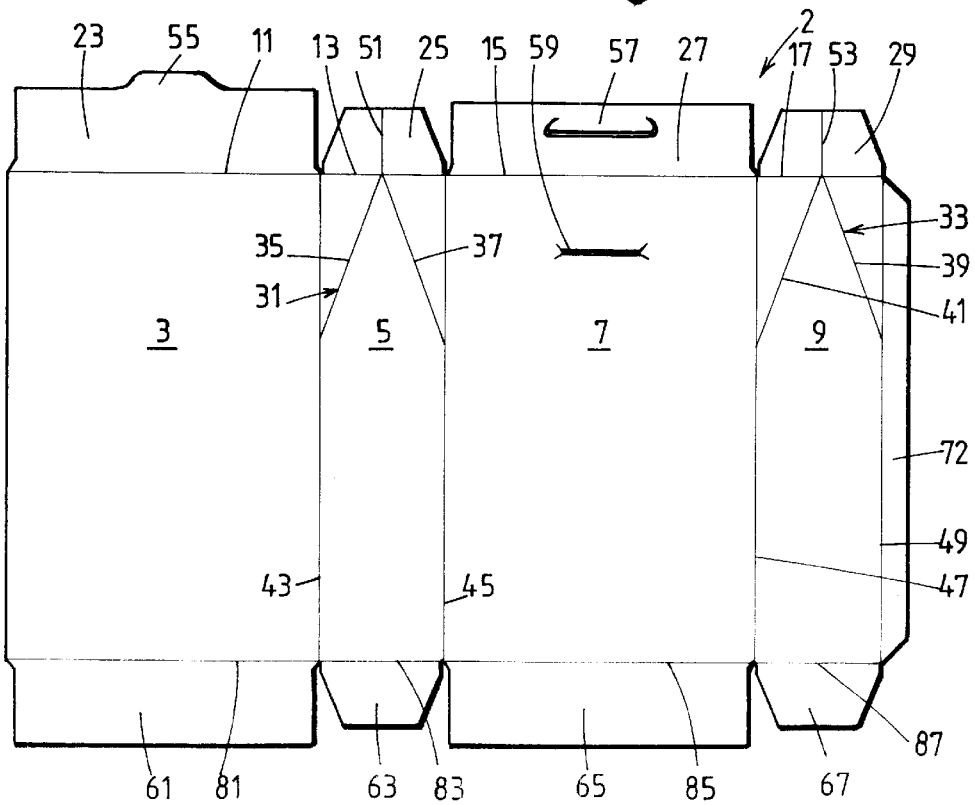
FIG. 5 is a view of the cut-out blank for forming the packaging shown in the previous figures.

The parallelepiped-shaped volume can be obtained by folding and gluing a cutout blank 2 of semi-rigid material such as cardboard, for example (see FIG. 5).

The wall 1 includes a first side 3, a second side 5, a third side 7 and a fourth side 9, in succession in that order, and respectively having a first edge 11, a second edge 13, a third edge 15 and a fourth edge 17 defining an opening 21, for example a rectangular opening.

A first flap 23, a second flap 25, a third flap 27 and a fourth flap 29 are respectively articulated to each of the aforementioned edges, the first flap 23 and the third flap 27 being wide enough to overlap at least in part.

According to one essential feature of the invention, a first group 31 and a second group 33 of deformation folding lines are formed on the second side 5 and the fourth side 9 of the wall 1.

The deformation folding lines are preferably formed by scoring, rows of perforations or other kinds of internal or external marking of the blank and substantially define inverted Y-shapes (when the opening 21 is at the top, i.e. as shown in FIG. 1) whose branches 35, 37 and 39, 41 respectively extend substantially from the middles of the second edge 13 and fourth edge 17 to edges 43, 45 and 47, 49 respectively separating the second side 5 and the fourth side 9 from the first side 3 and the third side 7, and whose stems 51 and 53 are in substantially median areas of the second flap 25 and the fourth flap 29.

The first flap 23 includes a tongue 55 and the third flap 27 and the third side 7 respectively include a first slot 57 and a second slot 59, both of which slots are adapted to receive the tongue 55.

The bottom of the packaging E is closed by a fifth flap 61, a sixth flap 63, a seventh flap 65 and an eighth flap 67 which are glued or stapled together, for example.

Figure 2:
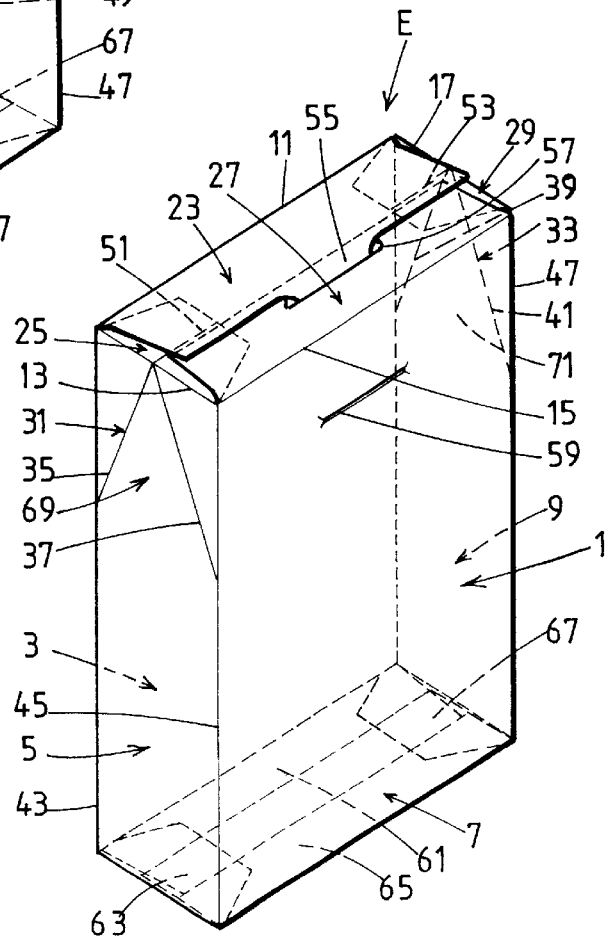

FIG. 2 shows the packaging E in a first storage configuration.

The first storage configuration is obtained from the previous configuration by folding the second flap 25 and the fourth flap 29 toward the interior of the packaging, folding the third flap 27 over them, and finally folding the first flap 23 over the third flap 27 and inserting the tongue 55 into the first slot 57.

Figure 3:
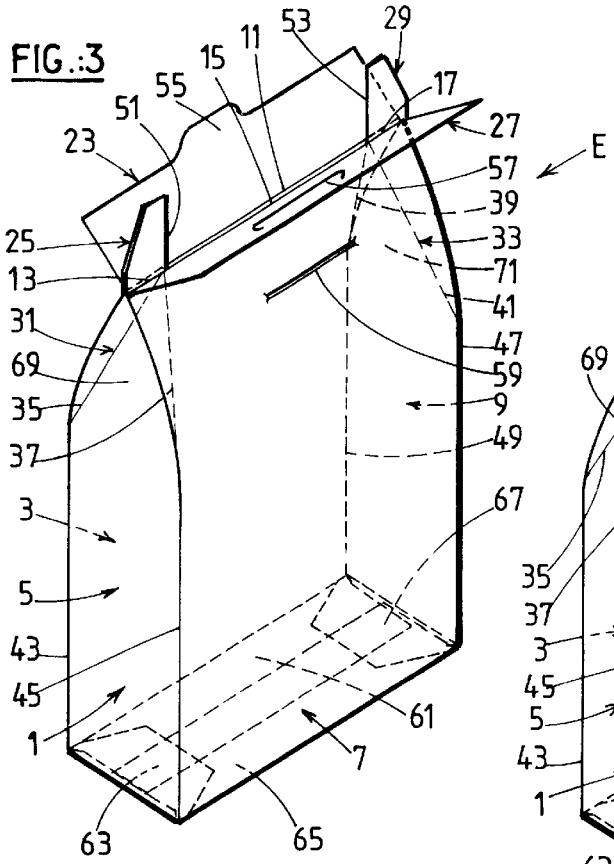
FIG. 3 is a similar view of the packaging in an intermediate configuration preceding a second storage configuration.

FIG. 3 shows the packaging E in an intermediate configuration preceding a second storage configuration.

The intermediate configuration is obtained from the service configuration shown in FIG. 1 by folding toward the interior of the packaging the portions 69 and 71 of the second side 5 and the fourth side 9 respectively situated between the branches 35, 37 and 39, 41 of the first group 31 and the second group 33 of deformation folding lines and by folding the second flap 25 and the fourth flap 29 in half around the stems 51 and 53 of the first and second groups of deformation folding lines so that the first edge 11 and the third edge 15 come into contact.

Figure 4:
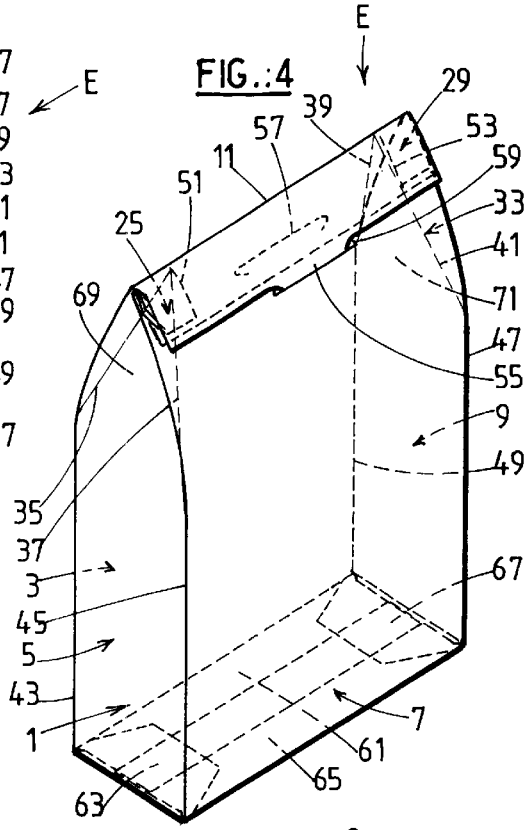
FIG. 4 is a similar view showing the packaging in its second storage configuration.

FIG. 4 shows the packaging E in its second storage configuration.

The second storage configuration is obtained from the previous configuration by folding the first flap 23, the second flap 25, the third flap 27 and the fourth flap 29 over the third side 7 and inserting the tongue 55 into the second slot 59.

FIG. 5 shows the blank 2 formed in a semi-rigid material such as cardboard and adapted to be folded and assembled to form the packaging E.

The figure shows that the blank 2 includes a first rectangular panel 3, a second rectangular panel 5, a third rectangular panel 7 and a fourth rectangular panel 9, in succession in that order, connected together by a first vertical folding line 43, a second vertical folding line 45 and a third vertical folding line 47.

The blank 2 also includes a gluing tab 72 connected to the fourth panel 9 by a fourth folding line 49.

The blank 2 further includes a first flap 23, a second flap 25, a third flap 27 and a fourth flap 29 respectively connected to the first panel 3, the second panel 5, the third panel 7 and the fourth panel 9 by a first horizontal folding line 11, a second horizontal folding line 13, a third horizontal folding line 15 and a fourth horizontal folding line 17.

The blank 2 further includes a fifth flap 61, a sixth flap 63, a seventh flap 65 and an eighth flap 67 respectively connected to the first panel 3, the second panel 5, the third panel 7 and the fourth panel 9 opposite the aforementioned four flaps by a fifth horizontal folding line 81, a sixth horizontal folding line 83, a seventh horizontal folding line 85 and an eighth horizontal folding line 87.

The blank 2 further includes a first group 31 and a second group 33 of deformation folding lines formed on the second panel 5 and the fourth panel 9 and on the second flap 25 and the fourth flap 29, substantially defining inverted Y-shapes whose branches 35, 37 and 39, 41 respectively extend substantially from the middles of the second horizontal folding line 13 and the fourth horizontal folding line 17 to the first vertical folding line 43 and the second vertical folding line 45, on the one hand, and to the third vertical folding line 47 and the fourth vertical folding line 49, on the other hand, and whose stems 51 and 53 are in substantially median areas of the second flap 25 and the fourth flap 29.

The first flap 23 includes a tongue 55 and the third flap 27 and the third side 7 respectively include a first slot 57 and a second slot 59 adapted to receive the tongue.

The first group 31 and the second group 33 of deformation folding lines are preferably formed by scoring, rows of perforations or other type of internal or external marking of the blank.

How the packaging according to the invention is used and its advantages flow directly from the preceding description.

To access the content of the packaging E for the first time, the conventional closure members (not shown) provided to make the packaging completely airtight are torn or peeled off and the first flap 23, the second flap 25, the third flap 27 and the fourth flap 29 are unfolded so that the packaging is in the service configuration shown in FIG. 1.

Where applicable, the flexible sachet inside the packaging is then opened.

The packaging E can be closed up again from the service configuration in two different ways.

A first way is to fold the packaging E as described above into its first storage configuration, that is shown in FIG. 2.

As anyone who eats breakfast cereal will be aware, this conventional storage configuration offers only a mediocre seal, given in particular the tendency of the first flap 23 and the third flap 27 to return to the open position because of their elasticity.

The second way is to fold the packaging E as described above into its second storage configuration, which is that shown in FIG. 4.

In this second storage configuration the first flap 1 clamps the wall 1 in a substantially airtight manner along the folding line 11.

This clamping is made possible by the first group 31 and the second group 33 of deformation folding lines.

Because of these lines and the relative flexibility of the material forming the wall 1, the wall can be deformed locally from a state in which the sides 3 and 7 are parallel throughout their height to a state in which the sides are parallel only in their lower parts (i.e. in the parts below the intersection of the branches 35, 37 and 39, 41 with the edges 43, 45 and 47, 49) and define a roof-shaped profile in their upper parts (i.e. in the parts above said intersections).

When the first flap 23, the second flap 25, the third flap 27 and the fourth flap 29 are folded over the third side 7 of the wall 1, the four edges 11, 13, 15 and 17 butt up against each other, which reinforces the clamping effect and thereby improves the seal obtained.

Note in particular that the second flap 25 and the fourth flap 29 prevent any ingress of air at the ends of the first edge 11 in the second storage configuration.

Note also that, if the contents of the packaging E are inside a flexible sachet, in the second storage configuration clamping the wall 1 can also hold the sachet in a position in which its top part is rolled up on itself, for example, which further improves the seal obtained.

Note also that in the second storage configuration the packaging E has a vertical overall size slightly less than that of its first storage configuration, enabling it to be stored on shelves with a relatively small distance between them, for example.

Note further that the locking of the opening 21 obtained when the packaging E is in its second storage configuration is significantly stronger than that obtained in its first storage configuration, and this enables the packaging to be stored on its side, for example, with no risk of its contents escaping and spilling.

Note further that the deformation which changes the packaging E from its service configuration to its second storage configuration is entirely reversible.

What is more, the packaging tends to return spontaneously to its service configuration as soon as the first flap is raised, thanks to the elasticity of the material forming the wall 1.

This is very practical because it provides access to the contents of the packaging E with minimum manipulation.

Of course, the present invention is not limited to the embodiment described and shown, which is provided by way of illustrative and non-limiting example only.

Thus the blank for forming the packaging in accordance with the invention could be formed in a semi-rigid plastics material, for example.

Thus only the part of the packaging in the region of its opening could be formed in a semi-rigid material, other parts of the packaging, such as its bottom, being formed of rigid materials.

Thus the wall forming the packaging could have only one edge defining an opening, for example a circular or elliptical opening.

Thus the packaging could have only one flap.

Thus the opening in the packaging could extend over only a portion of its top face.

Thus the deformation folding lines could be replaced by portions of the packaging that are easy to fold because they are more flexible than the remainder of the packaging.

What is claimed is:

1. A blank formed in a semi-rigid material such as cardboard and comprising:

first, second, third and fourth rectangular panels in succession in that order and connected to each other by first, second and third vertical folding lines, a gluing lug connected to the first panel by a fourth vertical folding line, first, second, third and fourth flaps respectively connected to said first, second, third and fourth panels by first, second, third and fourth horizontal folding lines, fifth, sixth, seventh and eighth flaps respectively connected to said first, second, third and fourth panels opposite said first, second, third and fourth flaps by fifth, sixth, seventh and eighth horizontal folding lines, and first and second groups of deformation folding lines formed on said second and fourth panels and on said second and fourth flaps, substantially defining inverted Y-shapes whose branches respectively extend substantially from the middles of said second and fourth horizontal folding lines to said first and second vertical folding lines, on the one hand, and to said third and fourth vertical folding lines, on the other hand, and whose stems are in substantially median areas of said second and fourth flaps, wherein said first flap includes a tongue and said third flap and said third panel respectively include first and second slots both adapted to receive said tongue.

2. The blank claimed in claim 1 wherein said first and second groups of deformation folding lines are formed by scoring, rows of perforations or other type of internal or external marking of said blank.

3. A packaging, comprising:

first, second, third and fourth sides in succession in that order defining respectively first, second, third and fourth edges of an opening for inserting articles in said packaging, at least a first flap hinged to said first edge, and reversible deformation means provided on said second and fourth sides, so that said packaging can be conformed selectively:

in a service configuration in which said first flap uncovers said opening, in a first storage configuration in which said first flap closes said opening, and in a second storage configuration in which said first flap clamps said first, second, third and fourth sides along said first, second, third and fourth edges, wherein said packaging further comprises second and fourth flaps which remain hinged respectively to said second and fourth edges after the first opening of said packaging, so that:

said second and fourth flaps uncover said opening when said packaging is conformed in said service configuration, said second and fourth flaps close said opening when said packaging is conformed in said first storage configuration, and wherein said first flap clamps said second and fourth flaps in a substantially sealed manner along said first and third edges when said packaging is conformed in said second storage configuration.

4. The packaging claimed in claim 3 wherein said reversible deformation means comprise first and'second groups of deformation folding lines provided on said second and fourth sides, respectively.

5. The packaging claimed in claim 4 wherein said first and second groups of deformation folding lines define inverted Y-shapes whose branches respectively extend substantially to the edges separating said second and fourth sides from said first and third sides and whose stems are in substantially median areas of said second and fourth flaps.

6. The packaging claimed in claim 5 wherein portions of said second and fourth sides situated respectively between the branches of said first and second groups of deformation folding lines are folded toward the interior of said packaging when said packaging is in said second storage configuration.

7. The packaging claimed in claim 5 wherein said second and fourth flaps are folded in half about said stems of said first and second groups of deformation folding lines when said packaging is in said second storage configuration.

8. The packaging claimed in claim 6 wherein said second and fourth flaps are folded in half about said stems of said first and second groups of deformation folding lines when said packaging is in said second storage configuration.

9. The packaging claimed in claim 3 further including a third flap hinged to said third edge.

10. The packaging claimed in claim 9 wherein said second and fourth flaps, on the one hand, and said third flap, on the other hand, are wedged between said first flap and said third side when said packaging is in said second storage configuration.

11. The packaging claimed in claim 3 further including first locking means for maintaining said packaging in said first storage configuration.

12. The packaging claimed in claim 11 further including a third flap hinged to said third edge, wherein said first locking means comprise a tongue formed in said first flap and a slot formed in said third flap adapted to receive said tongue.

13. The packaging claimed in claim 3 further including second locking means for maintaining said packaging in said second storage configuration.

14. The packaging claimed in claim 13 wherein said second locking means include a tongue formed in said first flap and a second slot formed in said third side and adapted to receive said tongue.

* * * * *